US010690130B2

(12) United States Patent
Takeuchi et al.

(10) Patent No.: US 10,690,130 B2
(45) Date of Patent: Jun. 23, 2020

(54) AIR COMPRESSOR

(71) Applicant: MAX CO., LTD., Tokyo (JP)

(72) Inventors: Katsuki Takeuchi, Tokyo (JP); Shinichi Ohkubo, Tokyo (JP)

(73) Assignee: MAX CO., LTD., Tokyo (JP)

( * ) Notice: Subject to any disclaimer, the term of this patent is extended or adjusted under 35 U.S.C. 154(b) by 149 days.

(21) Appl. No.: 15/229,246

(22) Filed: Aug. 5, 2016

(65) Prior Publication Data

US 2017/0037844 A1 Feb. 9, 2017

(30) Foreign Application Priority Data

Aug. 7, 2015 (JP) ..... 2015-156543

(51) Int. Cl.

| | |
|---|---|
| ***F04B 49/06*** | (2006.01) |
| ***F04B 35/04*** | (2006.01) |
| ***F04B 41/02*** | (2006.01) |
| ***F04B 49/10*** | (2006.01) |
| ***F04B 49/02*** | (2006.01) |
| ***F04B 39/06*** | (2006.01) |

(52) U.S. Cl.

CPC ..... *F04B 49/065* (2013.01); *F04B 35/04* (2013.01); *F04B 41/02* (2013.01); *F04B 49/02* (2013.01);

(Continued)

(58) Field of Classification Search

CPC .. F04B 17/03; F04B 35/04; F04B 49/06–065; F04B 49/20;

(Continued)

(56) References Cited

U.S. PATENT DOCUMENTS

2009/0288849 A1 11/2009 Iimura et al.
2010/0039055 A1* 2/2010 Jeung ..... H02P 6/00 318/400.08

(Continued)

FOREIGN PATENT DOCUMENTS

CN 101000051 A 7/2007
CN 103032352 A 4/2013

(Continued)

OTHER PUBLICATIONS

Extended European Search Report dated Jan. 3, 2017 in corresponding European patent application 16001737.2 (8 pages).

*Primary Examiner* — Alexander B Comley
(74) *Attorney, Agent, or Firm* — Faegre Drinker Biddle & Reath LLP

(57) ABSTRACT

An air compressor includes a tank unit, a compressed air generating unit, a motor unit, a driving current generating unit, a control unit and a temperature detecting unit. The tank unit stores a compressed air. The compressed air generating unit generates the compressed air to be stored in the tank unit. The motor unit drives the compressed air generating unit. The driving current generating unit generates a driving current of the motor unit. The control unit drives the motor unit by controlling the driving current generating unit. The temperature detecting unit detects a temperature of the driving current generating unit. The control unit changes the driving current of the motor unit by controlling the driving current generating unit based on the temperature detected by the temperature detecting unit.

6 Claims, 6 Drawing Sheets

(52) U.S. Cl.
CPC ..... *F04B 49/10* (2013.01); *F04B 39/066* (2013.01); *F04B 2203/0205* (2013.01); *F04B 2205/05* (2013.01); *F04B 2207/03* (2013.01)

(58) Field of Classification Search
CPC ..... F04B 2203/0205; F04B 2207/03; F04B 41/02; F04B 49/02; F04B 49/10; H02P 29/60; H02P 29/62; H02P 29/64; H02P 29/66; H02P 29/68
USPC ..... 417/32, 45; 318/400.08, 634, 641
See application file for complete search history.

(56) References Cited

U.S. PATENT DOCUMENTS

| | | | |
|---|---|---|---|
| 2010/0172764 | A1 | 7/2010 | Nakano et al. |
| 2011/0083450 | A1 | 4/2011 | Turner et al. |
| 2013/0084193 | A1 | 4/2013 | Beers et al. |
| 2015/0176575 | A1 | 6/2015 | Nemeth et al. |

FOREIGN PATENT DOCUMENTS

| | | | | |
|---|---|---|---|---|
| CN | 104736403 | A | 6/2015 | |
| EP | 2708429 | A1 * | 3/2014 | ..... F04B 49/065 |
| EP | A1-2708429 | | 3/2014 | |
| JP | A-S60125197 | | 7/1985 | |
| JP | A-H03195394 | | 8/1991 | |
| JP | 2009-052482 | A | 3/2009 | |
| JP | 2009-055719 | A | 3/2009 | |
| JP | 2009-127502 | A | 6/2009 | |
| JP | 2009-136054 | A | 6/2009 | |
| JP | A-2014030776 | | 2/2014 | |
| WO | WO-A1-200902846 | | 3/2009 | |

* cited by examiner

AIR COMPRESSOR

CROSS-REFERENCE TO RELATED APPLICATION

This application claims priorities from Japanese Patent Application No. 2015-156543 filed on Aug. 7, 2015, the entire contents of which are incorporated herein by reference.

FIELD

The present invention relates to an air compressor, and more particularly, to an air compressor in which a motor unit for generating a compressed air to be stored in a tank unit is driven by using a converter unit and an inverter unit.

BACKGROUND

So far, an air compressor is widely being used in a construction site to supply compressed air to a driving tool, such as a nail driving machine, using compressed air. The air compressor generates compressed air in a compressed air generating unit by driving a motor unit, and stores the generated compressed air in a tank unit. The stored compressed air of high pressure is reduced to predetermined pressure by a pressure reducing valve and then is supplied to the driving tool (for example, see Patent Document 1).

In the operation in the construction site or the like, the air compressor is often installed outdoors. For example, under scorching sun of midsummer, an air compressor may be installed and used on the concrete or may be installed and used inside the vehicle, and the temperature of the air compressor greatly rises depending on the environmental temperature (ambient temperature). Further, when the air compressor is installed inside the vehicle, and when the air compressor is installed on a wall side such as a building, the flow of the cooling air (air cooling) caused by an axial flow fan (a blower) or the like of the air compressor was blocked, and there was a risk of causing an excessive temperature rise.

Patent Document 1: Japanese Patent Publication No. 2009-55719

When the air compressor rises in temperature, the impedance of the motor unit is increased or a grease of a bearing unit flows out to cause a poor lubrication, the bearing is worn away, a gap of a sliding unit in the compressor (compressed air generating unit) decreases and sealing sections come into close contact with each other. Thus, there was a problem of an increase in load of the compressor. Furthermore, the abrasion proceeds by the close-contact of the sealing sections, and there was a risk of a damage of the sealing member (lip ring).

Further, an error may occur in the electronic component due to the temperature rise of the air compressor, or the sealing sections may break down by heat destruction or the like. In order to perform the error correction by restart, when an error occurs in some cases, there was also a need to temporarily suspend the operations. In some cases, there was a risk that the noise suppression components or the coil or the like cause a malfunction due to high temperature demagnetization and magnetic saturation, due to the temperature rise of the air compressor. In some cases, a trouble occurs in the operation of a user by these phenomena to cause a decrease in work efficiency.

To prevent the excessive temperature rise of the air compressor, a method of reducing the output of the motor unit or the like during a high temperature to reduce the load is also conceivable. However, since the rotational speed of the axial flow fan for cooling the motor unit and the like is also lowered with a decrease of output, there was a risk of a deterioration of the heat dissipation property. Further, although the method of performing the output reduction may be effective in some portions, there is also a risk of an occurrence of failure or the like in other portions, and the overall effects are not sufficient.

SUMMARY

The invention is made in view of the above problems, and is to provide an air compressor capable of suppressing the temperature rise, while performing the drive control of the motor unit or the like.

In order to solve the above problems, an air compressor according to the invention comprises:

a tank unit that stores a compressed air;

a compressed air generating unit that generates the compressed air to be stored in the tank unit;

a motor unit that drives the compressed air generating unit;

a driving current generating unit that generates a driving current of the motor unit;

a control unit that drives the motor unit by controlling the driving current generating unit; and a temperature detecting unit that detects a temperature of the driving current generating unit, wherein the control unit changes the driving current of the motor unit by controlling the driving current generating unit based on the temperature detected by the temperature detecting unit.

In the aforementioned air compressor, the control unit may change a load of the motor unit based on the temperature detected by the temperature detecting unit.

Further, the aforementioned air compressor may further include a motor temperature detecting unit that detects a temperature of the motor unit, wherein the control unit may control the driving current generating unit to change an upper limit value of the driving current of the motor unit based on the temperature detected by the motor temperature detecting unit.

Further, the aforementioned air compressor may further include an outside air temperature detecting unit that detects an outside air temperature, wherein the control unit may control the driving current generating unit to change an upper limit value of the driving current of the motor unit based on the temperature detected by the outside air temperature detecting unit.

In the air compressor according to the invention, the control unit controls the driving current generating unit based on the temperature detected by the temperature detecting unit, thereby changing the driving current of the motor unit. For example, by reducing the driving current for driving the motor unit, it is possible to suppress the driving force of the motor unit, and it is possible to suppress the temperature rise in the air compressor. Further, it is possible to suppress the temperature rise of the components such as a circuit substrate in the driving current generating unit, and it is possible to suppress the temperature rise in the air compressor. Also, since the suppression of the temperature rise is performed by different unit depending on the site in which a high temperature is detected, it is possible to continue the operation, while minimizing the output reduction of the air compressor.

DETAILED DESCRIPTION

Figure 1:
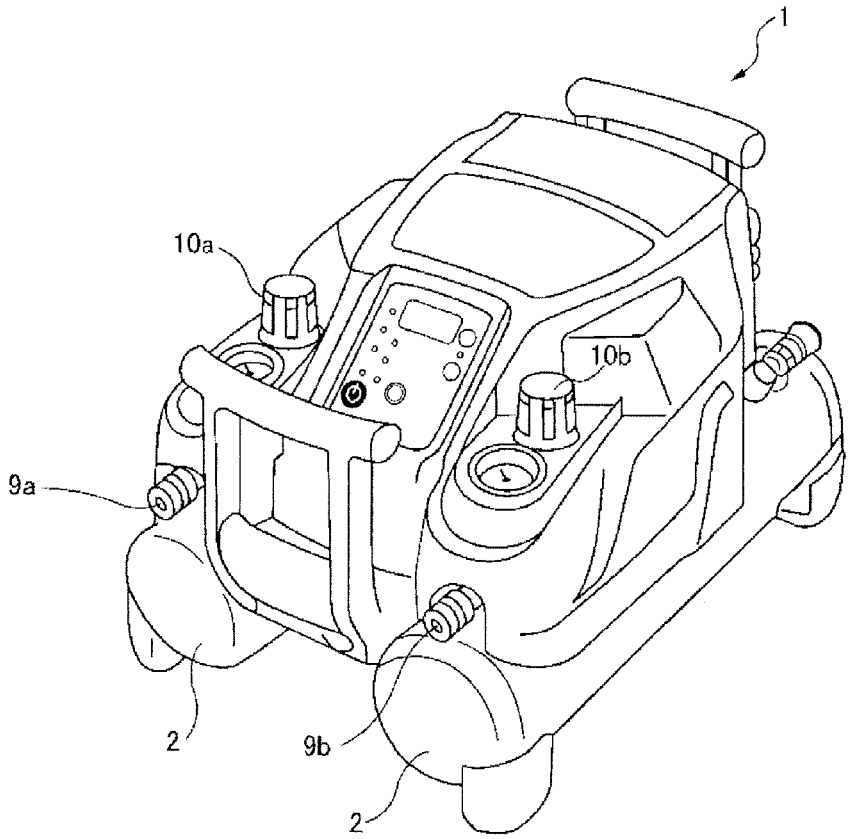
FIG. 1 is an external perspective view illustrating an air compressor according to an embodiment.
Figure 2:
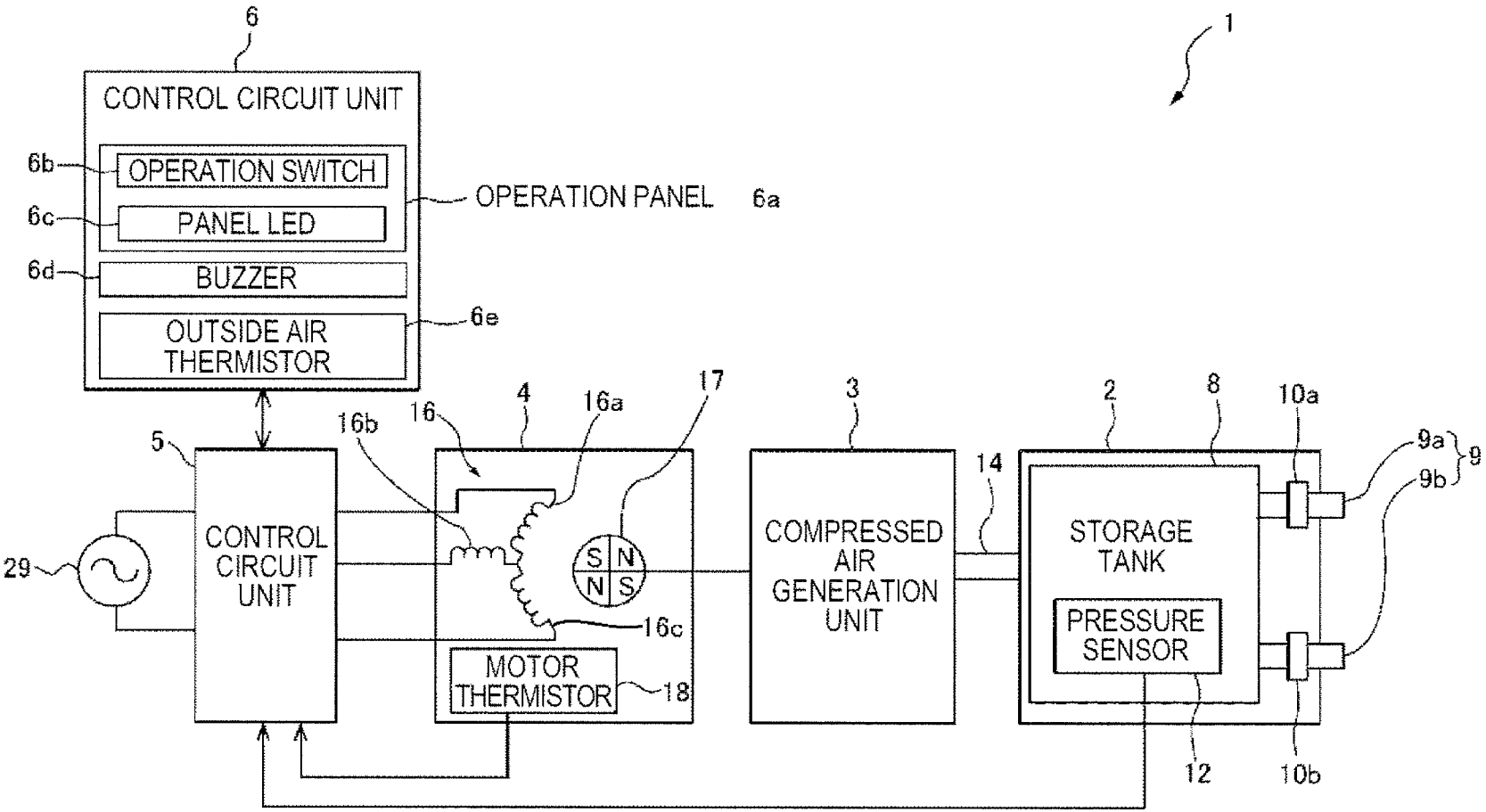
FIG. 2 is a block diagram illustrating a schematic configuration of the air compressor according to the embodiment.

Hereinafter, an example of a compressor according to the invention is illustrated and will be described in detail with reference to the drawings. FIG. 1 is a perspective view illustrating the exterior of the air compressor, and FIG. 2 is a block diagram illustrating a schematic configuration of the air compressor. An air compressor 1 is schematically configured by including a tank unit 2, a compressed air generating unit 3, a motor unit (a motor) 4, a control circuit unit 5, and an operation circuit unit 6.

The tank unit 2 includes a storage tank 8 for storing a compressed air. The compressed air of a predetermined pressure generated by the compressed air generating unit 3 is stored in the storage tank 8. In the air compressor 1 according to the present embodiment, the pressure of the storage tank 8 is changed depending on the usage status of the driving tool.

A plurality of compressed air outlet ports 9 is provided in the storage tank 8. In the present embodiment, a high-pressure outlet port 9*a* for taking out the high-pressure compressed air, and a normal-pressure outlet port 9*b* for taking out the normal-pressure compressed air are provided. Each of the outlet ports 9*a* and 9*b* is provided with pressure reducing valves 10*a* and 10*b* for decompressing the compressed air obtained from each of the outlet ports 9*a* and 9*b* to the desired pressure.

The compressed air in the storage tank 8 is maintained at a pressure higher than the pressure required for using the driving tool. Therefore, the compressed air taken out of the high-pressure outlet port 9*a* and the compressed air taken out of the normal-pressure outlet port 9*b* are also able to maintain the desired pressure by the pressure reducing valves 10*a* and 10*b*. An air hose (not illustrated) can be attached to and detached from each of the outlet ports 9*a* and 9*b* in order to supply the compressed air reduced in pressure by the pressure reducing valves 10*a* and 10*b* to the driving tool such as a nailing machine, and the like.

Further, the storage tank 8 is provided with a pressure sensor 12 for detecting the pressure in the storage tank 8. The pressure sensor 12 has a function of converting a pressure change in the storage tank 8 into an electric signal by an internal pressure-sensitive element, and the detected electric signal is output to the control circuit unit 5 as pressure information (a pressure value in the tank unit 2).

The compressed air generating unit 3 has a structure that generates a compressed air by causing a piston provided in the cylinder to reciprocate and by compressing the air drawn from an intake valve of the cylinder into the cylinder. The compressed air is supplied to the storage tank 8 of the tank unit 2 via a connecting pipe 14.

The motor unit 4 serves to generate a driving force for causing the piston of the compressed air generating unit 3 to reciprocate. The motor unit 4 is provided with a stator 16 and a rotor 17 for generating the driving force. The stator 16 is formed with a U-phase winding 16*a*, a V-phase winding 16*b*, and a W-phase winding 16*c*, and the rotating magnetic field is formed by making a current flow to the windings 16*a* to 16*c*. The rotor 17 is constituted by the permanent magnet, and the rotation of the rotor 17 is performed by the rotating magnetic field formed by the current flowing through the windings 16*a*, 16*b*, and 16*c* of the stator 16.

Further, the motor unit 4 is provided with a motor thermistor for detecting the temperature of the motor unit 4. Here, the thermistor is a semiconductor of which a resistance value greatly changes with changes in temperature, and it is possible to obtain the temperature information by detecting the resistance value in the control circuit unit 5. A motor thermistor (motor temperature detection unit) 18 is disposed between the windings 16*a* to 16*c* to detect the temperature state in the stator 16 and the rotor 17. The temperature information (resistance value information) of the motor unit 4 detected by the motor thermistor 18 is output to the control circuit unit 5.

The motor unit 4 is provided with an axial fan (a blower) (not illustrated) for the purpose of cooling the motor unit 4. The motor unit 4 is provided inside the housing of the air compressor 1, and the axial fan serves to take in the outside air via a slit provided in the housing and blow the outside air to the motor unit 4. Although the rotational speed of the axial fan is generally set and changed depending on the driving state (the type of operation mode) of the motor unit 4, in the case of high temperature save mode to be described later, it is possible to set and change the rotational speed of the axial fan by a microprocessor 20 of the control circuit unit 5.

The operation circuit unit 6 is a circuit unit that constitutes the operation panel 6*a* for allowing a user to set the operation mode or the like of the air compressor 1. The operation panel 6*a* is provided with an operating switch 6*b* and a panel LED 6*c*. In this embodiment, as the operation panel 6*a*, for example, an operation mode switch for setting the operation mode, and a power switch for performing turning ON/OFF of the power supply and the like are provided. By pressing the operation mode switch, the operation mode set in the air compressor 1 can be selected from three operation modes of a power mode, an artificial intelligence (AI) mode, and a silent mode.

The air compressor 1 is configured so that, basically, when the pressure value in the tank unit 2 is equal to or higher than a stop pressure value (hereinafter, referred to as an OFF pressure value.), the driving of the motor unit 4 is stopped, and when the pressure value of the tank unit 2 is equal to or lower than a restart pressure value (hereinafter, referred to as an ON pressure value.), the driving of the motor unit 4 is started. Depending on the selected operation mode, the ON pressure value and the OFF pressure value are set to different pressure values.

The panel LED 6*c* serves as a display unit for visibly displaying the type of the operation mode set by operation of the operating switch 6*b*, the pressure value in the tank unit 2 and the like. When an error occurs, by displaying an error message or an error number and the like on the panel LED 6*c*, it is possible to perform the error report to the user.

Further, the operation circuit unit 6 is provided with an outside air thermistor 6*e* for detecting the outside air temperature, and a buzzer 6*d*. Because the operation circuit unit 6 is provided in the housing of the air compressor 1, it tends to be hardly affected by the driving of the air compressor 1 as compared to the motor unit 4 and the control circuit unit 5 provided inside the air compressor 1. Therefore, by providing the outside air thermistor 6*e* in the operation circuit unit 6, it is possible to detect the temperature equal to the outside air temperature. The temperature information (resistance value information) of the outside air detected in the outside air thermistor 6*e* is output to the control circuit unit 5. Further, the panel LED 6*c* is able to display the outside air temperature detected by the outside air thermistor 6*e*. The buzzer 6*d* has a structure in which the report sound is output when an error occurs.

Figure 3:
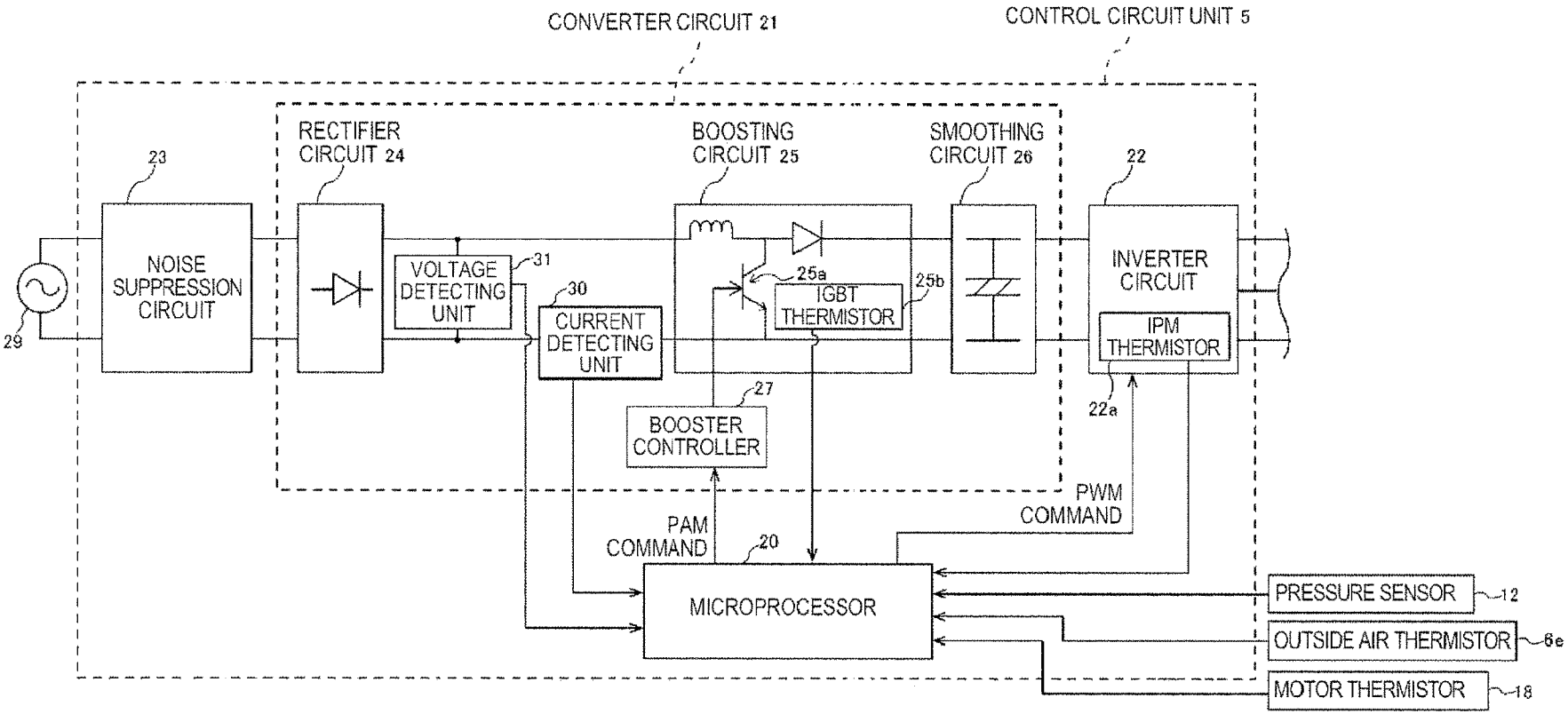
FIG. 3 is a block diagram illustrating a schematic configuration of a control circuit unit according to the embodiment.

As illustrated in FIG. 3, the control circuit unit 5 is schematic configured to include a microprocessor (MPU: Micro Processing Unit, control unit) 20, a converter circuit (converter unit) 21, an inverter circuit (inverter unit) 22, and a noise suppression circuit 23.

The noise suppression circuit 23 is a circuit for suppressing noise of the input current (AC current) from an alternating current power source 29 serving as a drive source of the air compressor 1, and has a role as a noise filter. The noise suppression circuit 23 outputs the input current (AC current) to the converter circuit 21, after removing a noise superimposed on the input current (AC current) from the alternating current power source 29.

The converter circuit 21 is schematically configured to include a rectifying circuit 24, a boosting circuit 25, and a smoothing circuit 26. A so-called PAM (Pulse Amplitude Modulation) control is performed by the converter circuit 21. Here, the PAM control is a method of controlling the rotational speed of the motor unit 4, by changing the pulse height of the output voltage by the converter circuit 21. Meanwhile, in the inverter circuit 22, a so-called PWM (Pulse Width Modulation) control is executed. The PWM control is a method of controlling the rotational speed of the motor unit 4 by changing the pulse width of the output voltage.

The microprocessor 20 executes a control by suitably switching a PAM control using the converter circuit 21 and a PWM control using the inverter circuit 22 depending on the operating state of the air compressor 1.

The rectifying circuit 24 and the smoothing circuit 26 of the converter circuit 21 have a role of converting the alternating current, in which the noise is removed (suppressed) by the noise suppression circuit 23, into the direct current voltage, by rectifying and smoothing the alternating current. A switching element 25*a* is provided inside the boosting circuit 25, and has a role of performing the amplitude control of the direct current voltage in accordance with the control command of the microprocessor 20. The boosting circuit 25 is controlled via a booster controller 27 which receives the PAM commands of the microprocessor 20.

Further, the boosting circuit 25 is provided with a boosting circuit thermistor for detecting the temperature in the boosting circuit 25 of the control circuit unit 5. In this embodiment, for convenience of explanation, the boosting circuit thermistor will be referred to as an IGBT (Insulated Gate Bipolar Transistor) thermistor (converter temperature detecting unit) 25*b*. The temperature information (resistance value information) of the boosting circuit 25 detected in the IGBT thermistor 25*b* is output to the microprocessor 20.

A current detecting unit 30 is provided between the rectifying circuit 24 and the boosting circuit 25 of the converter circuit 21. The current value detected in the current detecting unit 30 is output to the microprocessor 20. When the microprocessor 20 controls the converter circuit 21 and the inverter circuit 22 to drive the motor unit 4, an upper limit is set on the current value of the motor used to drive the motor unit 4. The current value corresponding to the upper limit is set to the control current value. The microprocessor 20 controls the converter circuit 21 and the inverter circuit 22 so that the current value detected in the current detecting unit 30 is equal to or lower than the control current value, and drives the motor unit 4. Therefore, by changing the setting of the control current value, it is possible to control the driving force of the motor unit 4.

A voltage detecting unit 31 is provided between the rectifying circuit 24 and the boosting circuit 25 of the converter circuit 21. The voltage value detected by the voltage detecting unit 31 is a value of a primary voltage before the voltage value is boosted via the boosting circuit 25 and the like, and the voltage value indicates a voltage value of the alternating current power source 29. Therefore, by detecting the voltage value at the voltage detecting unit 31, it is possible to determine what level of primary voltage is supplied to the alternating current power source 29. The drive voltage value detected by the voltage detecting unit 31 is output to the microprocessor 20.

The inverter circuit 22 has a role of converting the pulses of the direct current voltage converted by the converter circuit 21 into the positive and negative levels at a constant frequency, and converting the direct current voltage into the alternating current voltage having a quasi-sine wave by converting the pulse width. By adjusting the pulse width, it is possible to control the rotational speed of the motor unit 4. The microprocessor 20, by adjusting the output value of the inverter circuit 22, it is possible to control the driving amount of the motor unit 4.

Further, a motor driver thermistor for detecting the temperature of the inverter circuit 22 is provided in the inverter circuit 22. In this embodiment, for convenience of explanation, the motor driver thermistor will be referred to as an IPM (Intelligent Power Module) thermistor (inverter temperature detecting unit) 22*a*. The temperature information (resistance value information) of the inverter circuit 22 detected at the IPM thermistor 22*a* is output to the microprocessor 20.

The microprocessor 20 has the role of performing the driving of the motor unit 4 by performing the drive control of the converter circuit 21 and the inverter circuit 22, and for stabilizing the pressure of the compressed air in the tank unit 2 to the pressure condition within a predetermined range. The microprocessor 20 is provided with an arithmetic process unit (CPU: Central Processing Unit), a RAM (Random Access Memory) which is used as a temporary storage area such as a work memory, a ROM (Read Only Memory) on which a control process program (for example, a program related to the process illustrated in FIGS. 4 to 6, an ON pressure value and an OFF pressure value in each operation mode, etc.) or the like described later is recorded, and the like.

The pressure information (the pressure value in the tank unit 2) of the compressed air in the tank unit 2 detected by the pressure sensor 12, the temperature information of the outside air temperature detected by the outside air thermistor 6*e*, and the temperature information of the motor unit 4 detected by the motor thermistor 18 are input to the microprocessor 20. Further, the current value information detected by the current detecting unit 30 and the voltage value information detected by the voltage detecting unit 31 are input to the microprocessor 20. Further, the temperature information of the inverter circuit 22 detected by the IPM thermistor 22*a* and the temperature information of the boosting circuit 25 detected by the IGBT thermistor 25*b* are input to the microprocessor 20.

Meanwhile, the microprocessor 20 has a configuration that is capable of outputting the control information (PAM command, PWM command) to the converter circuit 21 and the inverter circuit 22. In the converter circuit 21 and the inverter circuit 22, the drive control of the motor unit 4 is performed based on the control information that is output by the microprocessor 20.

The microprocessor 20 controls the switching element 25*a* of the boosting circuit 25 via the boost controller 27 and performs the drive control of the converter circuit 21 by outputting the PAM command to the boost controller 27. Similarly, the microprocessor 20 controls the inverter circuit 22 by outputting the PWM command to the inverter circuit 22.

In the microprocessor 20, when performing the PAM control or the PWM control, an amount of operation of the converter circuit 21 and the inverter circuit 22 is determined and the drive control of the motor unit 4 is performed so as to become a target control current value and a pressure value in the tank unit 2, based on the drive current value of the motor unit 4 detected by the current detecting unit 30, and the pressure information detected by the pressure sensor 12.

Further, it is possible to control the rotational speed of the axial fan (blower) of the motor unit 4 described above by the microprocessor 20. The rotational speed of the axial fan is basically set in accordance with the operation mode. However, when the control state (control mode) is shifted to a high temperature save mode to be described later, the microprocessor 20 sets and changes the rotational speed of the axial fan at a predetermined rotational speed.

Figure 4:
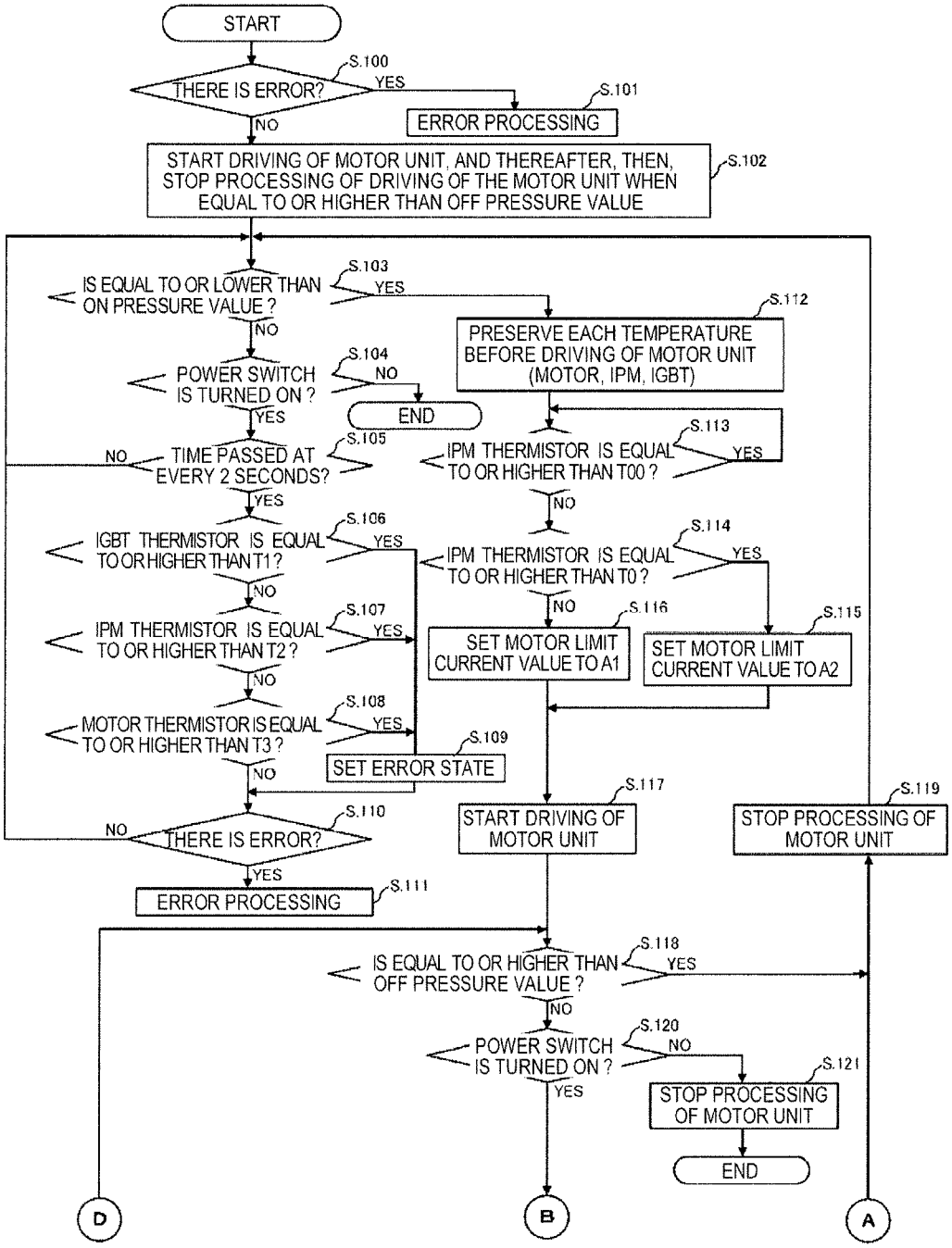
FIG. 4 is a flowchart illustrating a part of the process contents in a microprocessor according to the embodiment.
Figure 5:
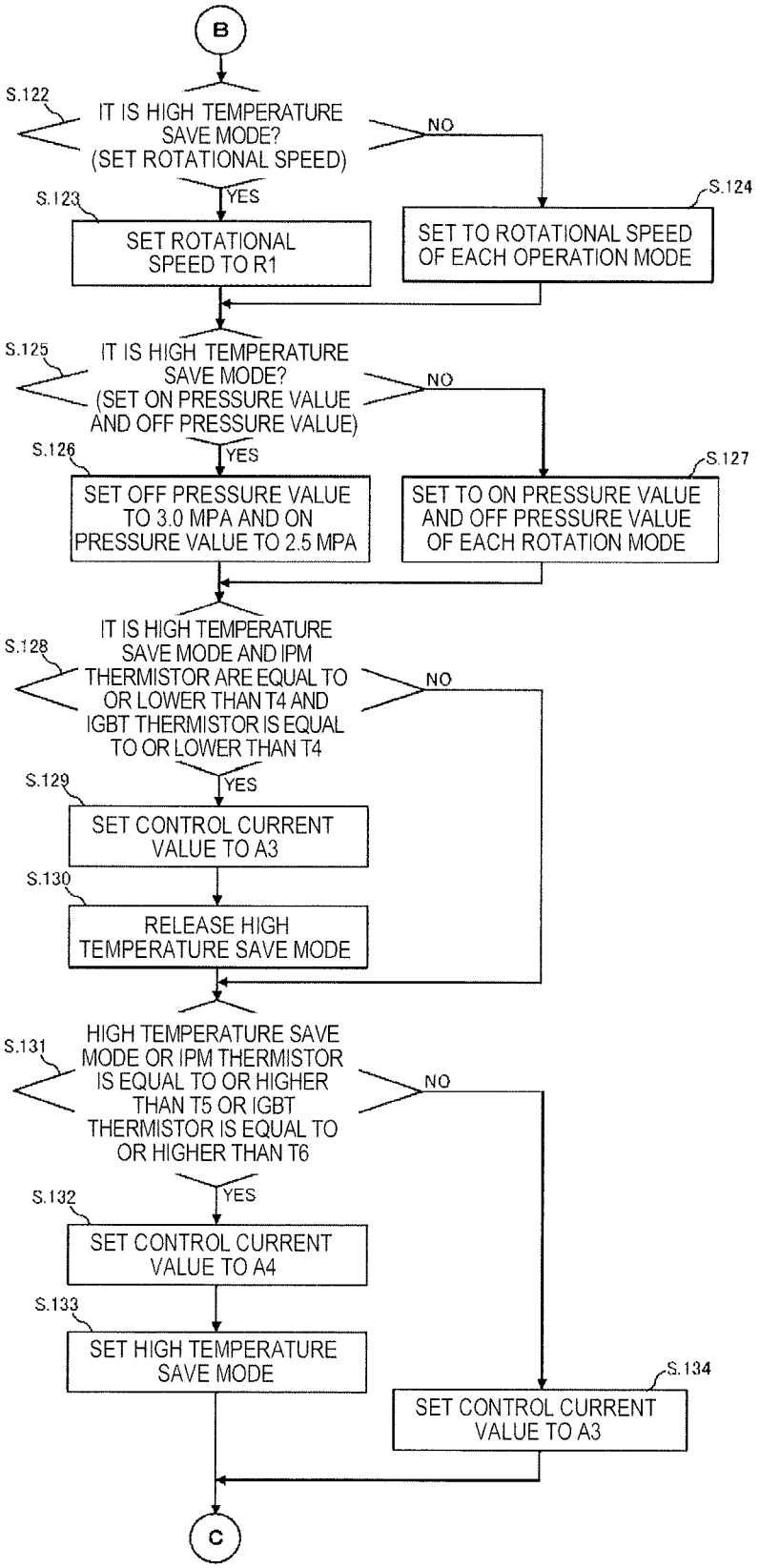
FIG. 5 is a flowchart illustrating a part of the process contents in the microprocessor according to the embodiment.
Figure 6:
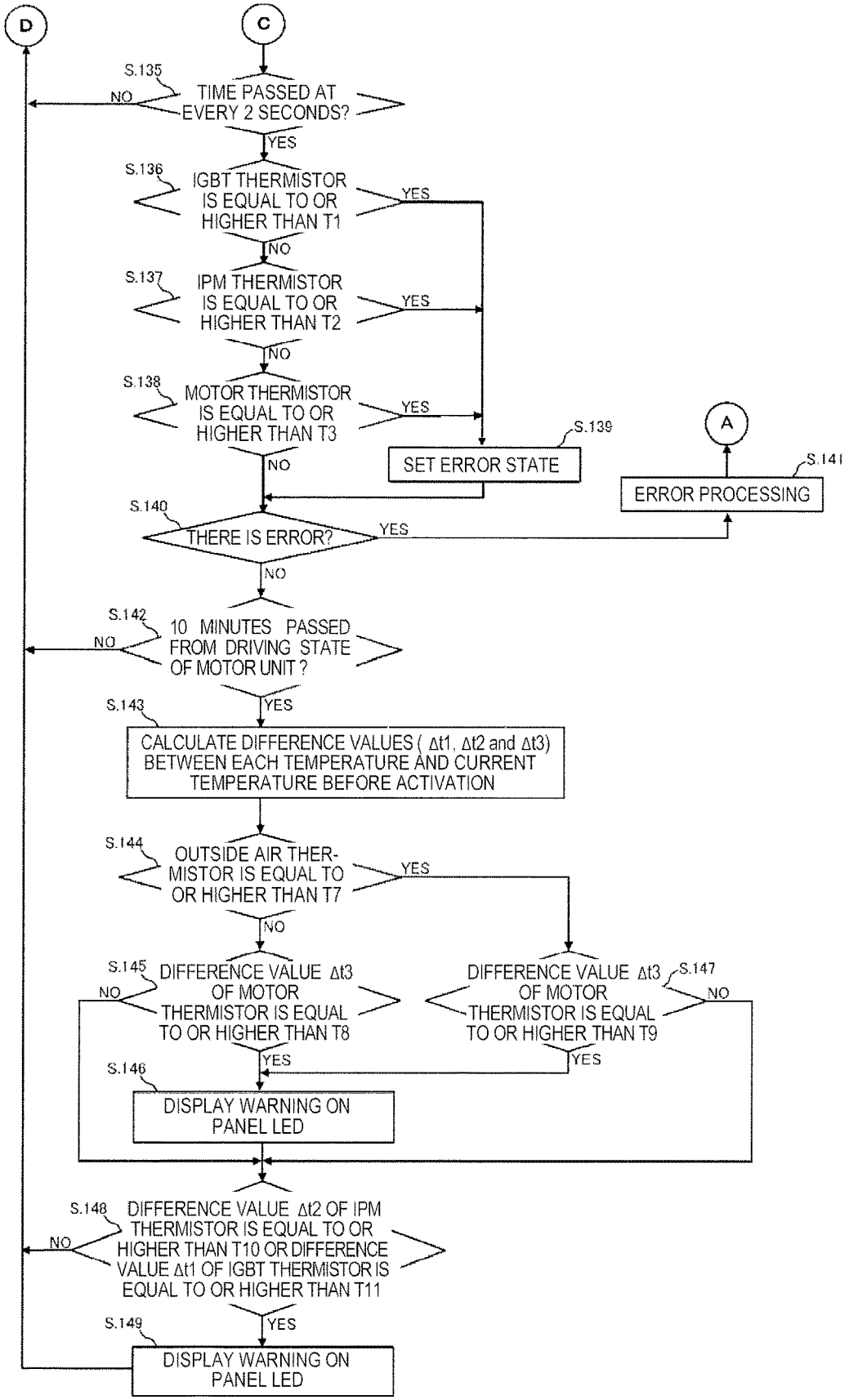
FIG. 6 is a flowchart illustrating a part of the process contents in the microprocessor according to the embodiment.

Next, process contents of the microprocessor 20 will be described. FIGS. 4 to 6 are flowcharts illustrating a series of process contents in which the microprocessor 20 performs the error report processing, the rotational speed setting process of the axial fan, the setting process of the ON pressure value and the OFF pressure value, the control current value setting process and the like, based on the temperature detected by the IGBT thermistor 25*b*, the IPM thermistor 22*a*, and the motor thermistor 18. In FIGS. 4 to 6, in addition to the control process performed based on the thermistors 25*b*, 22*a*, and 18, the process is also performed which drives the motor unit 4 when the pressure value in the tank unit 2 is equal to or lower than the ON pressure value, and stops the motor unit 4 when the pressure value in the tank unit 2 is equal to or higher than the OFF pressure value.

First, the process contents of the microprocessor 20 will be briefly described. The microprocessor 20 performs the error process on the assumption that the temperature exceeds the temperature at which the air compressor 1 can normally operate (permissive temperature), when the temperature of the IGBT thermistor 25*b* is equal to or higher than T1 (for example, 120° C.), the temperature of the IPM thermistor 22*a* is equal to or higher than T2 (for example, 120° C.) or the temperature of the motor thermistor 18 is equal to or higher than T3 (for example, 120° C.). Even below the temperature at which the microprocessor performs the error processing, when the temperature of the IGBT thermistor 25*b* is equal to or higher than T6 (for example, 110° C.) or the temperature of the IPM thermistor 22*a* is equal to or higher than T5 (for example, 110° C.), the microprocessor 20 shifts the control mode indicating the temperature state of the air compressor 1 from the normal mode (normal temperature mode) to the high temperature save mode. In the control mode, when the microprocessor 20 performs the ON/OFF setting of a flag recorded in a predetermined area of the RAM, it is determined whether the control mode is a high temperature save mode or a normal mode.

In the high temperature save mode, when the temperature of the IGBT thermistor 25*b* is equal to or lower than T4 (for example, 90° C.) and the temperature of the IPM thermistor 22*a* is equal to or lower than T4 (for example, 90° C.), the microprocessor 20 shifts the control mode from the high temperature save mode to the normal mode (releases the high temperature save mode). In this way, the temperature (for example, 90° C. to 110° C.), which is ranged from T5 (for example, 110° C.) of the IPM thermistor 22*a* which is shifted to the high temperature save mode, up to T4 (for example, 90° C.) of the IPM thermistor 22*a* in which the high temperature save mode is maintained, corresponds to the inverter-high-temperature temperature value in the present invention. In addition, the temperature (for example, 90° C. to 110° C.), which is ranged from T6 (for example, 110° C.) of the IGBT thermistor 25*b* which is shifted to the high temperature save mode up to T4 (for example, 90° C.) of the IGBT thermistor 25*b* in which the high temperature save mode is maintained, corresponds to the converter-high-temperature temperature value in the present invention.

When the control mode is shifted to the high temperature save mode, the microprocessor 20 sets the rotational speed of the axial fan to the rotational speed R1 (for example, 2500 rpm), sets the OFF pressure value to 3.0 MPa, sets the ON pressure value to 2.5 MPa, and sets the control current value to A4 (for example, 13 A).

By setting the rotational speed of the axial fan at the rotational speed R1 (for example, 2500 rpm), it is possible to suppress the temperature rise of the motor unit 4 and the compressed air generating unit 3, while ensuring the air blowing cooling capability of the motor unit 4 and the compressed air generating unit 3. Also, by setting the OFF pressure value to 3.0 MPa and by setting the ON pressure value to 2.5 MPa, it is possible to reduce the pressure conditions in the tank unit 2 to be maintained, thereby suppressing the driving load of the motor unit 4 and the compressed air generating unit 3. Furthermore, it is possible to suppress the temperature rise of the components such as the common coils of the boosting circuit 25 and the noise suppression circuit 23 as well as the motor unit 4 and the compressed air generating unit 3.

By setting the control current value to A4 (for example, 13 A) to reduce the control current value (change from A3 (for example, 15 A) to A4 (for example, 13 A)), it is possible to suppress the temperature rise in the components such as the boosting circuit 25 and the noise suppression circuit 23.

Next, the process contents in the microprocessor 20 will be described. First, the microprocessor 20 determines whether there is an error, by reading the presence or absence of error information that is recorded in a predetermined area of the RAM, from the RAM (S.100). The process in which the error information is recorded on the RAM will be described later. When it is determined that there is an error by the error information of RAM (Yes in S.100), the microprocessor 20 performs the error process (S.101). Specifically, the error contents are reported by performing to display the error occurrence to the panel LED 6*c*, and a buzzer sound is generated by a buzzer 6*d* to perform the reporting.

When it is determined that there is no error (No in S.100), the microprocessor 20 performs a process of controlling the converter circuit 21 and the inverter circuit 22 to start the driving of the motor unit 4, and thereafter, stopping the driving of the motor unit 4 after the pressure value in the tank unit 2 becomes equal to or higher than the OFF pressure value (S.102). The OFF pressure value in the process (S.102) is determined based on the operation mode that is determined by operating the operating switch 6*b* through a user. Also, the determination on whether the pressure value in the tank unit 2 is equal to or higher than the OFF pressure value is performed based on the pressure information (pressure value in the tank unit 2) obtained from the pressure sensor 12.

After the pressure value in the tank unit 2 becomes equal to or higher than the OFF pressure value and the driving of the motor unit 4 is stopped (S.102), the microprocessor 20 determines whether the pressure value in the tank unit 2 is equal to or lower than the ON pressure value (S.103). When the pressure value in the tank unit 2 is not equal to or lower than the ON pressure value (No in S.103), the microprocessor 20 determines whether the power switch is set to ON (S.104).

When the power switch is not set to ON (No in S.104), the microprocessor 20 terminates the processing. Meanwhile, when the power switch is set to ON (Yes in S.104), the microprocessor 20 performs the time passage determination at every 2 seconds after the power switch of the air compressor 1 is turned ON (S.105). When there is a timing of the time passage at every 2 seconds after the power switch is turned ON (Yes in S.105), and more particularly, when there is a timing immediately after the time passage after the passage of time at every 2 seconds, temperature determination process which will be described later (S.106 to S.108 and the like) is performed. When there is no timing of the passage of time at every 2 seconds after the power switch is turned ON (No in S.105), the microprocessor 20 shifts the process to determination process of whether the pressure value is equal to or lower than the ON pressure value described above (S.103) and repeatedly performs the process subsequent to S.103.

When there is a timing of the time passage at every 2 seconds after the power switch is turned ON (Yes in S.105), the microprocessor 20 determines whether the temperature detected by the IGBT thermistor 25*b* is equal to or higher than T1 (for example, 120° C.) (S.106). When the temperature of the IGBT thermistor 25*b* is not equal to or higher than T1 (No in S.106), the microprocessor 20 determines whether the temperature detected by the IPM thermistor 22*a* is equal to or higher than T2 (for example, 120° C.) (S.107). When the temperature of the IPM thermistor 22*a* is not equal to or higher than T2 (No in S.107), the microprocessor 20 determines whether the temperature detected by the motor thermistor 18 is equal to or higher than T3 (for example, 120° C.) (S.108).

When the temperature of the IGBT thermistor 25*b* is equal to or higher than T1 (Yes in S.106), or when the temperature of the IPM thermistor 22*a* is equal to or higher than T2 (Yes in S.107) or when the temperature of the motor thermistor 18 is equal to or higher than T3 (Yes in S.108), the microprocessor 20 performs the set process of the error state, by recording the error information by each temperature rise on the RAM (S.109).

When performing the set process of the error state (S.109) or when the temperature of the motor thermistor 18 is not equal to or higher than T3 (No in S.108), the microprocessor 20 determines whether there is an error based on the error information recorded on the RAM (S.110). When it is determined that there is an error by the error information of RAM (Yes in S.110), the microprocessor 20 performs the error process in the same manner as in S.101 (S.111). When it is determined that there is no error (No in S.110), the microprocessor 20 shifts the process to the process of S.103 and repeatedly performs the process subsequent to S.103.

Meanwhile, when the pressure value in the tank unit 2 is equal to or lower than the ON pressure value (Yes in S.103), the microprocessor 20 performs the process of storing in the RAM, by setting the temperatures detected by the IGBT thermistor 25*b*, the IPM thermistor 22*a*, and the motor thermistor 18 as the temperature before the driving of the motor unit 4 (S.112). Further, the microprocessor 20 determines whether the temperature detected by the IPM thermistor 22*a* is equal to or higher than T00 (for example, 100° C.) (S.113).

When the temperature of the IPM thermistor 22*a* is equal to or higher than TOO (Yes in S.113), the microprocessor 20 maintains the activation waiting state of the motor unit 4 by making a determination on whether the temperature detected by the IPM thermistor 22*a* is equal to or higher than TOO again. Meanwhile, when the temperature of the IPM thermistor 22*a* is not equal to or higher than TOO (No in S.113), the microprocessor 20 performs the process of releasing the activation waiting state of the motor unit 4 by shifting the process to S.114. Further, the microprocessor 20 makes a determination on whether the temperature detected by the IPM thermistor 22*a* is equal to or higher than T0 (for example, 95° C.) (S.114).

When the temperature of the IPM thermistor 22*a* is equal to or higher than T0 (Yes in S.114), the microprocessor 20 performs the process of setting the motor limit current value to A2 (for example, 7 A) (S.115). Meanwhile, when the temperature of the IPM thermistor 22*a* is not equal to or higher than T0 (No in S.114), the microprocessor 20 performs the process of setting the motor limit current value to A1 (for example, 10 A) (S.116).

Here, the motor limit current value is a current value for controlling the amount of activation power used when the driving of the motor unit 4 is started. When the temperature of the IPM thermistor 22*a* is equal to or higher than T0 (for example, 95° C.), it is possible to determine that the temperature of the inverter circuit 22 is at a relatively high temperature state. Therefore, when the temperature of the IPM thermistor 22*a* is not equal to or higher than T0, the motor limit current value is set to A1. However, when the temperature is equal to or higher than T0 and the temperature of the inverter circuit 22 is determined to be high, by setting the motor limit current value to A2, a process of lowering the current value at the time of the driving start of the motor unit 4 is performed. With such a process, even when the sealing sections of the compressed air generating unit 3 come into close contact with each other at a high temperature and the sliding resistance increases, since an excessive amount of activation power does not rise, it is possible to suppress the amount of activation power of the motor unit 4 in the air compressor 1 at the time of activation, and it is possible to suppress the temperature rise.

After performing the setting process of the motor current limit value (S.115 and S.116), the microprocessor 20 performs a process for starting the driving of the motor unit 4 (S.117). Thereafter, the microprocessor 20 determines whether the pressure value in the tank unit 2 is equal to or higher than the OFF pressure value (S.118). When the pressure value in the tank unit 2 is equal to or higher than the OFF pressure value (Yes in S.118), the microprocessor 20 performs a process of stopping the motor unit 4 (S.119). After the motor unit 4 is stopped, the microprocessor 20 shifts the process to S.103 and repeatedly performs the process subsequent to S.103.

When the pressure value in the tank unit 2 is not equal to or higher than the OFF pressure value (No in S.118), the microprocessor 20 determines whether the power switch is set to ON (S.120). When the power switch is not set to ON (No in S.120), the microprocessor 20 terminates the process, after performing the process (S.121) of stopping the motor unit 4.

Meanwhile, when the power switch is set to ON (Yes in S.120), the microprocessor 20 performs the rotational speed setting determination process of the axial fan (S.122 to S.124). First, the microprocessor 20 determines whether the control mode is a high temperature save mode, based on the flag information of the control mode which is recorded on the RAM (S.122). When the control mode is the high temperature save mode (Yes in S.122), the microprocessor 20 sets the rotational speed of the axial fan to the rotational speed R1 (for example, 2500 rpm) (S.123). In the case of high temperature save mode, by setting the rotational speed of the axial fan to the rotational speed R1, it is possible to enhance the air blowing cooling effect of the motor unit 4 and the compressed air generating unit 3. Therefore, it is possible to suppress the temperature rise in the air compressor 1.

Meanwhile, when the control mode is not the high temperature save mode (No in S.122), the microprocessor 20 sets the rotational speed of the axial fan to a predetermined rotational speed that is predetermined by the operation mode (the power mode, the AI mode, and the silent mode) (S.124). The rotational speed of each the operation mode is recorded on the ROM, and the microprocessor 20 reads the rotational speed information corresponding to each operation mode from the ROM and sets the rotational speed of the axial fan.

After performing the rotational speed setting process of the axial fan (S.123 and S.124), the microprocessor 20 performs the ON pressure value and the OFF pressure value setting process (S.125 to S.127). First, the microprocessor 20 makes a determination on whether the control mode is a high temperature save mode (S.125), and in the case of a high temperature save mode (Yes in S.125), the microprocessor 20 sets the OFF pressure value to 3.0 MPa and sets the ON pressure value to 2.5 MPa (S.126). In this way, in the case of high temperature save mode, by setting the ON pressure value and the OFF pressure value to a relatively low value, it is possible to reduce the load of the motor unit 4 and the compressed air generating unit 3, and it is possible to suppress an increase in temperature in the air compressor 1.

When there is no high temperature save mode (No in S.125), the microprocessor 20 performs setting to the ON pressure value and the OFF pressure value predetermined by the operation mode (the power mode, the AI mode, and the silent mode) (S.127). The ON pressure value and the OFF pressure value of each operation mode is recorded on the ROM, and the microprocessor 20 performs the setting by reading the information of the ON pressure value and the OFF pressure value corresponding to the operation mode from the ROM.

After performing the setting process of the ON pressure value and the OFF pressure value (S.126 and S.127), the microprocessor 20 determines whether three conditions are satisfied, in which the control mode is the high temperature save mode, the temperature of the IPM thermistor 22*a* is equal to or lower than T4 (for example, 90° C.), and the temperature of the IGBT thermistor 25*b* is equal to or lower than T4 (for example, 90° C.) (S.128).

When the temperature of the rpm thermistor 22*a* is equal to or lower than T4 and the temperature of the IGBT thermistor 25*b* is equal to or lower than T4, it is possible to determine that the air compressor 1 is not in the high temperature state. When the control mode is the high temperature save mode in this state, it is possible to determine that the preceding temperature state is a high temperature state but the temperature dropped. Therefore, when the three conditions are satisfied (Yes in S.128), the microprocessor 20 performs the process of setting the control current value to A3 (for example, 15 A) (S.129) and also setting the flag related to the control mode recorded on the RAM to OFF to release the high temperature save mode (set to the normal mode) (S.130).

When the three conditions are not satisfied (No in S.128), or when setting of the high temperature save mode is released (S.130), the microprocessor 20 makes a determination on whether at least one condition among the three conditions is satisfied, in which the control mode is the high temperature save mode, the temperature of the IPM thermistor 22*a* is equal to or higher than T5 (for example, 110° C.), and the temperature of the IGBT thermistor 25*b* is equal to or higher than T6 (for example, 110° C.) (S.131).

When satisfying at least one of three conditions (Yes in S.131), it is possible to determine that the air compressor 1 is in the high temperature state. Therefore, in the case of satisfying at least one condition (Yes in S.131), the microprocessor 20 sets the control current value to A4 (for example, 13 A) (S.132), and sets the flag related to the control mode recorded on the RAM to ON, thereby performing the setting process of the high temperature save mode (S.133).

After the setting process of the high temperature save mode (S.133), a process for setting a PWM period to a lower value may be performed. By lowering the PWM period, it is possible to reduce the driving load of the compressed air generating unit 3 and the motor unit 4 and to suppress the temperature rise of the inverter circuit 22 or the like.

When the driving load is reduced by lowering the PWM period, although the temperature rise can be alleviated, for example, when the PWM period is changed from about 20 kHz to about 10 kHz, driving in the audible range is caused, and the driving sound becomes noticeable. Therefore, only when the pressure in the tank unit 2 rises and the operation sound of the compression mechanism increases, a control of lowering the PWM period may be performed to reduce the effects of noise.

When none of the conditions among the three conditions is satisfied (No in S.131), the microprocessor 20 sets the control current value to A3 (for example, 15 A) (S.134). After the control current value is set to A3 (for example, 15 A) (S.134) or after the setting of the high temperature save mode is performed (S.133), the microprocessor 20 performs the time passage determination at every 2 seconds (S.135). The time passage determination at every 2 seconds in S.135 is the same as the process of S.105.

When there is no timing of the time passage at every 2 seconds (No in S.135), the microprocessor 20 shifts the process to the determination process on whether the pressure value is equal to or higher than the OFF pressure value (S.118), and repeatedly performs the processes subsequent to S.118.

Meanwhile, when there is a timing of the time passage at every 2 seconds (Yes in S.135), the microprocessor 20 performs the temperature determination process (S.136 to S.138 and the like). When there is a timing of the time passage at every 2 seconds (Yes in S.135), the microprocessor 20 determines whether the temperature detected by the IGBT thermistor 25*b* is equal to or higher than T1 (for example, 120° C.) (S.136). When the temperature of the IGBT thermistor 25*b* is not equal to or higher than T1 (No in S.136), the microprocessor 20 determines whether the temperature detected by the IPM thermistor 22*a* is equal to or higher than T2 (for example, 120° C.) (S.137). When the temperature of the IPM thermistor 22*a* is not equal to or higher than T2 (No in S.137), the microprocessor 20 determines whether the temperature detected by the motor thermistor 18 is equal to or higher than T3 (for example, 120° C.) (S.138).

When the temperature of the IGBT thermistor 25*b* is equal to or higher than T1 (Yes in S.136), when the temperature of the IPM thermistor 22*a* is equal to or higher than T2 (Yes in S.137) or when the temperature of the motor thermistor 18 is equal to or higher than T3 (Yes in S.138), the microprocessor 20 performs the setting process of the error condition, by recording the error information by each of the temperature rise on the RAM (S.139).

When performing the setting process of the error state (S.139) or when the temperature of the motor thermistor 18 is not equal to or higher than T3 (No in S.138), the microprocessor 20 makes a determination on whether there is an error, based on the error information recorded on the RAM (S.140). When it is determined that there is an error by the error information of RAM (Yes in S.140), the microprocessor 20 performs the error process (S.141). Specifically, the error contents are reported to the panel LED 6*c* by performing the display of the error occurrence, and the report is performed by generating a buzzer sound using the buzzer 6*d*. Further, the microprocessor 20 performs the stop process of the motor unit 4 (S.119), shifts the process to S.103, and repeatedly performs the processes subsequent to S.103.

In the driving state of the motor unit 4, when the temperature of the IGBT thermistor 25*b* is equal to or higher than T1 (Yes in S.136) or when the temperature of the IPM thermistor 22*a* is equal to or higher than T2 (Yes in S.137) or when the temperature of the motor thermistor 18 is equal to or higher than T3 (Yes in S.138), the air compressor 1 is in the high temperature state, and when the motor unit 4 is driven as it is, there is a risk of an occurrence of a failure or the like in the air compressor 1. Therefore, when it is determined that there is an error (Yes in S.140), after the microprocessor 20 performs the error process (S.141), by stopping the motor unit 4 (S.119), it is possible to prevent the failure or the like of the air compressor 1.

When it is determined that there is no error (No in S.140), the microprocessor 20 determines whether 10 minutes have elapsed from the start of driving of the motor unit 4 (S.142). When 10 minutes have not elapsed from the start of driving of the motor unit 4 (No in S.142), the microprocessor 20 shifts the process to the aforementioned S.118 and repeatedly performs the processes subsequent to S.118.

When 10 minutes elapsed from the start of driving of the motor unit 4 (Yes in S.142), the microprocessor 20 calculates a difference value between the temperature of the IGBT thermistor 25*b*, the IPM thermistors 22*a* and the motor thermistor 18 measured in S.112 and the temperature of the IGBT thermistor 25*b*, the IPM thermistors 22*a* and the motor thermistor 18 to be currently measured (S.143).

More particularly, the microprocessor 20 obtains to what degree the temperature rises from before the driving of the motor unit 4 as a difference value Δt1, by subtracting the temperature of the IGBT thermistor 25*b* prior to driving of the motor unit 4 recorded on the RAM from the currently measured temperature of the IGBT thermistor 25*b*. Further, the microprocessor 20 obtains to what degree the temperature rises from before the driving of the motor unit 4 as a difference value Δt2, by subtracting the temperature of the IPM thermistor 22*a* prior to driving of the motor unit 4 recorded on the RAM from the currently measured temperature of the IPM thermistor 22*a*. Further, the microprocessor 20 obtains to what degree the temperature rises from before the driving of the motor unit 4 as a difference value Δt3, by subtracting the temperature of the motor thermistor 18 prior to driving of the motor unit 4 recorded on the RAM from the currently measured temperature of the motor thermistor 18.

Thereafter, the microprocessor 20 determines whether the current temperature measured by the outside air thermistor 6*e* is equal to or higher than T7 (for example, 30° C.) (S.144). In the case of being not equal to or higher than T7 (No in S.144), the microprocessor 20 determines whether the difference value Δt3 in the motor thermistor 18 is equal to or higher than T8 (for example, 50° C.) (S.145). When the difference value Δt3 is equal to or higher than T8 (Yes in S.145), the microprocessor 20 performs a warning display on the panel LED 6*c* (S.146).

In the case of being equal to or higher than T7 (Yes in S.144), the microprocessor 20 determines whether the difference value Δt3 in the motor thermistor 18 is equal to or higher than T9 (for example, 30° C.) (S.147). When the difference value Δt3 is equal to or higher than T9 (Yes in S.147), the microprocessor 20 performs the warning display on the panel LED 6*c* (S.146).

In this way, at the time of the lapse of 10 minutes from the start of driving of the motor unit 4, when the temperature of the motor unit 4 rises above the difference value to be assumed, by the warning display using the panel LED 6*c*, it is possible to call attention to a user. Especially, because the tendency of the temperature rise varies depending on the status of the outside air temperature, the determination of the difference values in the motor unit 4 is set to the different values depending on whether the outside air temperature is equal to or higher or lower than T7.

When making a warning display using the panel LED 6*c* (S.146), when the difference value Δt3 is not equal to or higher than T8° C. (No in S.145) or when the difference value Δt3 is not equal to or higher than T9 (No in S.147), the microprocessor 20 makes a determination on whether the difference value Δt2 in IPM thermistor 22*a* is equal to or higher than T10 (for example, 50° C.) or the difference value Δt1 in the IGBT thermistor 25*b* is equal to or higher than T11 (for example, 70° C.) (S.148).

When the difference value Δt2 is equal to or higher than T10 or when the difference value Δt1 is equal to or higher than T11 (Yes in S.148), the microprocessor 20 performs a warning display on the panel LED 6*c* (S.149). In this way, at the time of the lapse of 10 minutes from the start of driving of the motor unit 4, when the temperature of the boosting circuit 25 and the inverter circuit 22 rises above the assumed difference value, it is possible to call attention to the user by the warning display using the panel LED 6*c*.

When the warning display is performed using the panel LED 6*c* (S.149), even when the difference value Δt2 is not equal to or higher than T10 and when the difference value Δt1 is not equal to or higher than T11 (No in S.149), the microprocessor 20 shifts the process to the above-described S.118 and repeatedly performs the processes subsequent to S.118.

As described above, in the air compressor 1 according to the present embodiment, the temperature of the motor unit 4 is detected by the motor thermistor 18, the temperature of the boosting circuit 25 is detected by the IGBT thermistor 25*b*, and the temperature of the inverter circuit 22 is detected by the IPM thermistor 22*a*. Further, when the temperature of the IGBT thermistor 25*b* is equal to or higher than T6 or when the temperature of the IPM thermistor 22*a* is equal to or higher than T5, the control mode is shifted to the high temperature save mode.

In the case of the high temperature save mode, the microprocessor 20 sets the rotational speed of the axial fan to the high rotational speed. By setting the rotational speed of the axial fan to be higher, it is possible to secure the sufficient blowing cooling capacity of the motor unit 4 and the compressed air generating unit 3, and it is possible to suppress an increase in temperature of the motor 4 and the compressed air generating unit 3.

In the case of high temperature save mode, the microprocessor 20 suppresses the driving load of the motor unit 4 and the compressed air generating unit 3, by lowering the setting of the ON pressure value and the OFF pressure value, and by reducing the pressure conditions in the tank unit 2. In this way, by suppressing the driving load of the motor unit 4 and the compressed air generating unit 3, it is possible to suppress the temperature rise of the components such as the boosting circuit 25 and the noise suppression circuit 23, as well as the motor unit 4 and the compressed air generating unit 3.

Furthermore, in the case of high temperature save mode, the microprocessor 20 performs a process for reducing the control current value. By reducing the control current value, it is possible to suppress the temperature rise of the components such as the boosting circuit 25 and the noise suppression circuit 23, and it is possible to prevent the temperature rise in the air compressor 1.

After the lapse of a predetermined time (10 minutes, as an example, in this embodiment) from the start of the driving of the motor unit 4, a difference value between the temperature before the start of driving the motor unit 4 and the temperature after 10 minutes is obtained from the temperature of the motor thermistor 18, the IPM thermistor 22*a* and the IGBT thermistor 25*b*. Further, when the difference value is large, by performing an alarm to the user using the panel LED 6*c*, it is possible to quickly inform the user of the temperature rise in the air compressor 1.

When the temperature of the motor thermistor 18, the IPM thermistor 22*a* and the IGBT thermistor 25*b* is equal to or higher than the predetermined stop reference value (equal to or higher than T3 in the motor thermistor 18, equal to or higher than T2 in the IPM thermistor 22*a*, and equal to or higher than T1 in the IGBT thermistor 25*b*), since the air compressor 1 is in the high temperature state, by forcibly stopping the operation of the motor unit 4 of the air compressor 1, it is possible to prevent the failure of the air compressor 1.

While the air compressor according to the invention is described in detail with reference to the drawings in conjunction with an example, the air compressor according to the invention is not limited only to the configuration of the air compressor 1 illustrated in the embodiments. It would be appreciated to those skilled in the art that various changes and modifications are conceivable within the scope described in the claims, and it is possible to achieve the effects similar to those of the air compressor 1 illustrated in the embodiments.

For example, in the error detection of the embodiments, the values of temperature used as an example, 120° C. in the IGBT thermistor 25*b*, 120° C. in the IPM thermistor 22*a*, and 120° C. in the motor thermistor 18 are an example, and the invention is not limited to these temperature values. Since each temperature greatly varies depending on the heat resistance performance of the parts constituting the air compressor 1 and the cooling performance of the axial fan, or the like, it is possible to set a temperature that is suitable for being determined as an error.

In the air compressor 1 according to an embodiment of the invention, as an example, when the IGBT thermistor 25*b* is equal to or higher than 110° C. or when the IPM thermistor 22*a* is equal to or higher than 110° C. (S.131), the process (S.133) of setting the control mode to the high temperature save mode was illustrated as an example. However, the temperature of setting the control mode to the high temperature save mode is not limited to 110° C. or 110° C. as described above, and when the temperature is set to be equal to or higher than other temperatures, it may be set to a high temperature save mode.

Furthermore, the determination time of the time passage determination process (for example, every 2 seconds in S.105, every 2 seconds in S.135, and 10 minutes in S.142) is not limited to the time described in the air compressor 1 according to the embodiment.

Additionally, various values such as numerical values illustrated in the process of the microprocessor 20 according to the embodiment, for example, the numerical values (2500 rpm which is an example of the rotational speed R1) for setting the rotational speed of the axial fan, the setting values of the ON pressure value and the OFF pressure value (OFF pressure value 3.0 MPa and ON pressure value 2.5 MPa), the setting values of the control current value (13 A as an example of A4 and 15 A as an example of A3), the values of warning determination based on the difference value between the current temperature and the temperature prior to activation of the motor unit 4 (T11 (for example, 70° C.) or higher of Δt1, T10 (for example, 50° C.) or higher of Δt2, T8 (for example, 50° C.) or higher of Δt3, T9 (for example, 30° C.) or higher of Δt3, T7 (for example, 30° C.) or higher of the outside air thermistor 6*e*) are an example, and are not limited to the numerical values illustrated in the embodiments.

The invention claimed is:

1. An air compression device comprising:

a tank that stores a compressed air;

an air compressor that generates the compressed air to be stored in the tank;

a motor that drives the air compressor;

a current generating circuit that generates a driving current of the motor;

a controller that drives the motor by controlling the current generating circuit;

a boosting circuit temperature sensor that detects a temperature of a boosting circuit of the current generating circuit; and a motor driver temperature sensor that detects a temperature of an inverter circuit of the current generating circuit, wherein the controller sets a motor limit current value of the driving current of the motor to a first predetermined current value when the motor driver temperature sensor detects that the temperature of the inverter circuit of the current generating circuit is higher than or equal to a first predetermined temperature, wherein after the controller sets the motor limit current value of the driving current of the motor, the controller reduces a load of the motor when the motor driver temperature sensor detects that the temperature of the inverter circuit of the current generating circuit is higher than a second predetermined temperature, wherein the second predetermined temperature is higher than the first predetermined temperature, and wherein after the controller sets the motor limit current value of the driving current of the motor, the controller reduces the load of the motor when the boosting circuit temperature sensor detects that the temperature of the boosting circuit of the current generating circuit is higher than a third predetermined temperature, wherein the third predetermined temperature is higher than the first predetermined temperature.

2. The air compression device according to claim 1, further comprising:

a motor temperature sensor that detects a temperature of the motor, wherein the controller sets the motor limit current value of the driving current of the motor to the first predetermined current value based on the temperature detected by the motor temperature sensor.

3. The air compression device according to claim 2, further comprising:

an outside air temperature sensor that detects an outside air temperature, wherein the controller sets the motor limit current value of the driving current of the motor to the first predetermined current value based on the temperature detected by the outside air temperature sensor.

4. The air compression device according to claim 1, further comprising:

a motor temperature sensor that detects a temperature of the motor, wherein the controller sets the motor limit current value of the driving current of the motor based on the temperature detected by the motor temperature sensor.

5. The air compression device according to claim 4, further comprising:

an outside air temperature sensor that detects an outside air temperature, wherein the controller sets the motor limit current value to the driving current of the motor to the first predetermined current value based on the temperature detected by the outside air temperature sensor.

6. The air compression device according to claim 1, further comprising:

an outside air temperature sensor that detects an outside air temperature, wherein the controller sets the motor limit current value of the driving current of the motor to the first predetermined current value based on the temperature detected by the outside air temperature sensor.

* * * * *